United States Patent [19]

Telle

[11] 4,357,010

[45] Nov. 2, 1982

[54] MULTIPURPOSE EXERCISING MACHINE

[76] Inventor: Jerome R. Telle, 460 Cody Dr., Golden, Colo. 80401

[21] Appl. No.: 204,881

[22] Filed: Nov. 7, 1980

[51] Int. Cl.[3] ..... A63B 21/06

[52] U.S. Cl. ..... 272/117; 272/130; 272/118

[58] Field of Search ..... 272/117, 116, 123, 130, 272/134, 143, 144, 118

[56] References Cited

U.S. PATENT DOCUMENTS

| | | | |
|---|---|---|---|
| Re. 28,066 | 7/1974 | Marcyan . | |
| 458,382 | 8/1891 | Zander | 272/117 |
| 2,855,199 | 10/1958 | Noland et al. . | |
| 2,932,509 | 4/1960 | Zinkin | 272/117 |
| 3,003,765 | 10/1961 | Dove | 272/117 |
| 3,588,101 | 6/1971 | Jungreis . | |
| 4,205,838 | 6/1980 | McIntosh | 272/123 |

OTHER PUBLICATIONS

"Types of Weight Training", Coach and Athlete, May–Jun. 1977.

"Centurion".

Keiser Hydraulic Lift.

*Primary Examiner*—Richard C. Pinkham

*Assistant Examiner*—William R. Browne

*Attorney, Agent, or Firm*—Wm. Griffith Edwards

[57] ABSTRACT

An exercising apparatus for developing selected muscles of the body comprises a rigid upright support having a first beam pivoted on a horizontal axis near the top of the support and a second beam similarly pivoted below the first beam. The two beams are connected by a telescopic adjustable link so that they move together at selected distances from one another. Handles and shoulder pads are provided for lifting the first beam and a weight holding rod is located on the outer end of the second beam for receiving a selected number of weights to be lifted. The rate of movement of the bars during lifting of the weights is maintained substantially constant by an isokinetic device connected between the structure and one of the beams. The combination of the two beams and the adjustable link facilitates the use of the apparatus for a wide range of sizes of people and a wide range of different exercises.

11 Claims, 8 Drawing Figures

MULTIPURPOSE EXERCISING MACHINE

My invention relates to exercising machines and particularly to an improved multi-purpose exercising machine of simple construction.

BACKGROUND OF THE INVENTION

Exercising machines which are effective for the exercising of selected muscles of the body have come into extensive use in training athletes and for providing exercising facilities for the public. Such machines have been developed and used for exercising specific muscles and a plurality of machines are required to provide complete body exercise. Some complex exercising machines have been provided which comprise a plurality of different machines built together as one unit and usable by a plurality of persons at one time, who move about the unit to each machine in turn. Some machines employ weights which are lifted during operation and which provide substantially constant tension mechanisms for resisting movement of selected muscles and thus are isotonic over a predetermined range of operation. Many such machines are provided with cams which vary the tension in a selected manner over the range of operation of the machines. Other machines employ an isokinetic device, such as a hydraulic cylinder and piston for driving liquid through an orifice of selected size for maintaining a constant rate of movement regardless of the force applied by the operator. In a further application the isotonic and isokinetic features have been combined to provide both functions in one machine. The isokinetic feature is needed to control the momentum factor of a traveling weight and the actual weights are needed to control the malingering factor which may occur when training on solely isokinetic equipment.

For the purpose of better utilization of space and for economy, it is desirable to minimize the number of machines required for an effective exercising facility and program, and to make the same exercising functions available to more individuals at the same time. Accordingly, it is an object of my invention to provide an improved exercising machine capable of multiple uses and which is simple, rugged and easily adjusted.

It is another object of my invention to provide an improved single exercising machine capable of use for a large number of exercising functions.

It is a further object of my invention to provide an improved exercising machine having combined isotonic and isokinetic actions and which affords its use for a wide range of different exercises.

SUMMARY OF THE INVENTION

Briefly, in carrying out the objects of my invention in one embodiment thereof, I provide an exercising machine having an upright supporting structure and upper and lower beam members pivoted on the structure. The lower beam is pivoted on the structure at an intermediate point on the beam and is arranged to receive weights at either end for resistance so that the beam may be biased to either direction of rotation. The upper beam is connected to the lower beam by an adjustable link, so that the two beams cooperate to provide a wide range of selected exercising positions. The link may be adjusted for positions ranging from a low squat position to a high shoulder press position, and the upper beam is provided with hand grips and with shoulder pads for use depending upon the position selected and the exercise to be performed. An isokinetic mechanism is connected between the lower beam and the supporting structure. This mechanism may, for example, be a hydraulic cylinder having a piston therein and a passage for transferring liquid from one end of the cylinder to the other when the piston is moved by movement of the beam. The passage has a restriction or orifice therein for limiting the rate of movement of the piston and thus of the beam. The exercising machine of this invention is of simple construction but is usable in a wide range of different exercises.

The features of novelty which characterize my invention are pointed out with particularity in the claims annexed to and forming a part of this sepcification. My invention itself, however, both as to its organization and its manner of operation, together with further objects and advantages thereof, will best be understood upon reference to the following description taken in connection with the accompanying drawings.

DESCRIPTION OF PREFERRED EMBODIMENT

Figure 1:
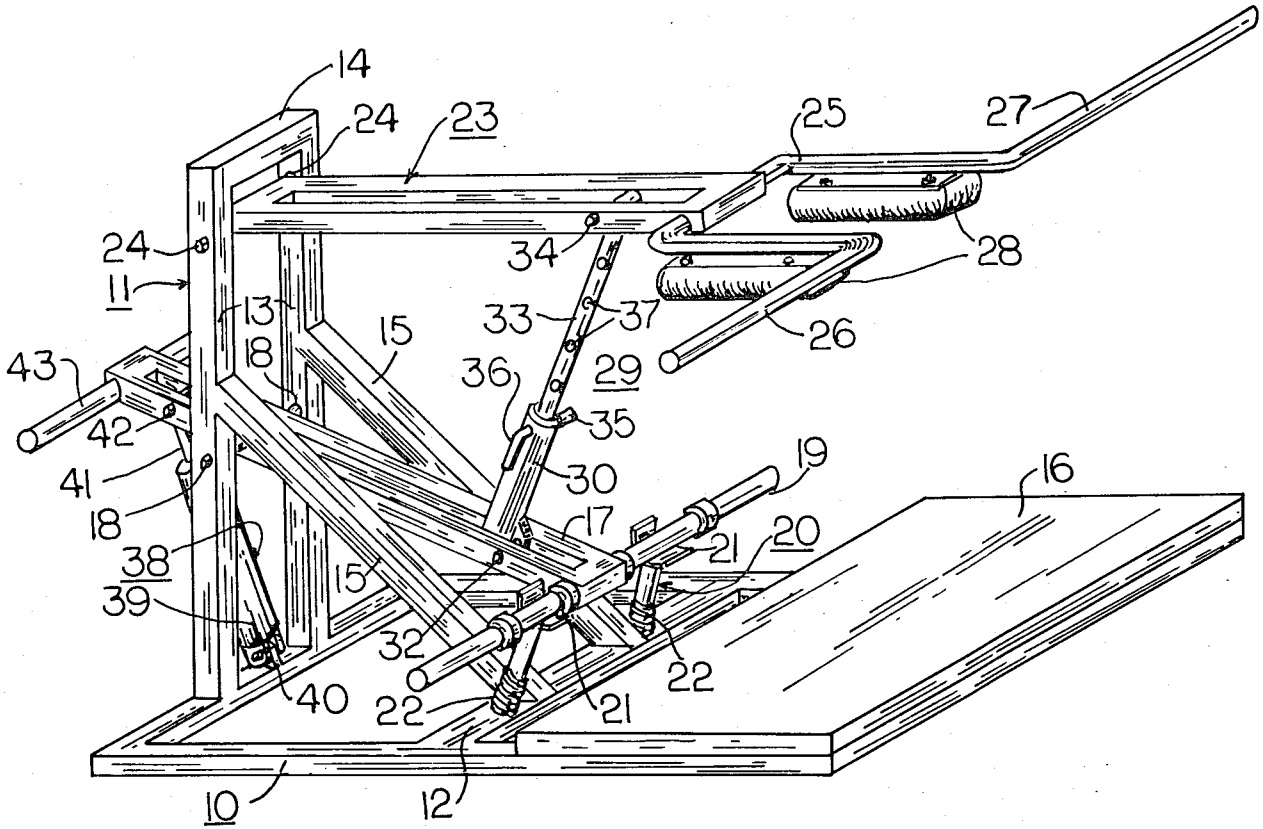
FIG. 1 is a somewhat diagrammatic isometric view of an exercising machine embodying my invention.

The exercising machine illustrated in FIG. 1 includes a base 10 and an upright support 11 made of tubular steel members of rectangular cross section. The base is of generally rectangular configuration and has a cross member 12 intermediate its ends. The base has a rectangular portion extending a substantial distance beyond the far side as viewed in FIG. 1. The upright support 11 comprises two columns 13 welded to the base at their bottom ends and connected together by a cross member 14 at their top ends. The upright member is secured rigidly to the cross member 14 by diagonal buttressing members 15 which are securely welded to the upright supports and to the cross member. A platform 16 is securely mounted on the frame 10 and to its lateral extension and provides the support on which the user stands.

Figure 5:
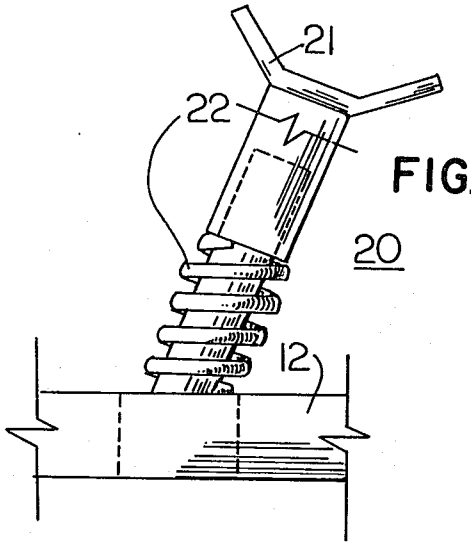
FIG. 5 is an enlarged view of a weight rest of the machine.

The weight on this machine which are to be lifted are mounted on the forward end of a beam 17 which is pivotally mounted for rotation about a horizontal shaft 18 secured between the columns 13 of the upright structure. The weights which may be round or disc-like plates (not shown in FIG. 1) are mounted on a shaft or rod 19 secured to the front end of the beam 17 and extending laterally on both sides thereof. Two compression spring rests 20 are mounted on the cross member 12 near the outer sides of the bottom ends of the buttressing members 15. The rests have upwardly open seat members 21 for receiving the rod 19 in its position of rest, and have shock absorbing springs 22 which act as buffers to prevent undue pounding of the structure should the weights be released and fall. The construction of the rests is more clearly shown in the enlarged view, FIG. 5. An upper beam 23 is pivoted on a shaft 24 mounted in the upper end of the upright structure between the columns 13; this beam is the operating beam which is gripped or pressed by the operator. The beam is provided with a U-shaped rod 25 rigidly secured to its front end and having lateral extensions 26 and 27 which serve as hand grips and shoulder pads 28 secured to the legs of the U for pressing engagement with user's shoulders. This arrangement allows the user to exercise while standing on the platform 16 and placing the pads 28 against his shoulders and with his head extending upwardly between the pads.

In order that the weights on the beam 17 may be lifted by movement of the beam 23, an adjustable link 29 is pivotally connected to both beams. The link 29 comprises a sleeve 30 having a projection 31 pivotally connected to the beam 17 by shaft 32, and an inner tubular rod 33 slidably mounted in the sleeve and pivotally connected by a shaft 34 to the beam 23. The sleeve and rod 33 are adjustable by selective positioning of a pin 35 having a handle 36. The pin is adapted to pass through opposite holes at the top of the sleeve 30 and to pass through any one of a plurality of pairs of spaced holes 37 in the rod 33. The length of the tubular rod 33 allows a wide range of adjustments of the link 29 and when in its lowest position the rod extends a substantial distance beyond the lower end of the sleeve and in its top position is sufficiently high for very tall users.

An isokinetic device 38 is connected between the base 10 and the beam 17 at a point rearwardly of the shaft 18. The device 38 has been illustrated as of the hydraulic type including a cylinder 39 pivoted at its closed end to a lug 40 on the base, and having a plunger rod 41 extending from its other end and pivoted to the beam 17 by a rod or bolt 42. The rod 41 is secured to a piston (not shown) within the cylinder. When the piston is moved by inward pressure on the rod 41 the rate of movement is limited by an orifice through which the liquid must pass. On reverse movement, the piston and rod 41 are free to return to their initial position. It will be understood that other forms of isokinetic devices may be used by connecting them to act between one of the beams and the stationary structure. The hydraulic isokinetic device is arranged to limit the rate of movement and thus control the momentum factor of weights traveling at different speeds in one direction. The device as shown in FIG. 1 allows free return movement; these devices may be made to act to limit the rate of movement in either direction depending upon the requirements of the mechanism with which they are used.

The lateral arm or handle 27 is substantially longer than the arm 26 and allows a person standing on the laterally extending portion of the platform 16 to use the handle 27 while standing either in front or in back of the handle.

When the beam 23 is lifted to raise weights positioned on the rod 19, the device 38 limits the rate of movement. If no weights are placed on the rod 19 the resistance to movement is essentially the effective weight of the beams together with the resistance offered by the device 38. For some users exercises may be desirable in which even less weight is applied and for this purpose weights may, for example, be placed on a rod 43 secured to the rear end of the beam 17.

The exercising machine of this invention thus is adjustable for a wide range of the sizes and strengths of the users and may employ a wide range of weights. This adjustability in combination with the use of both isotonic and isokinetic characteristics provides a simple but versatile exercising unit.

Figure 2:
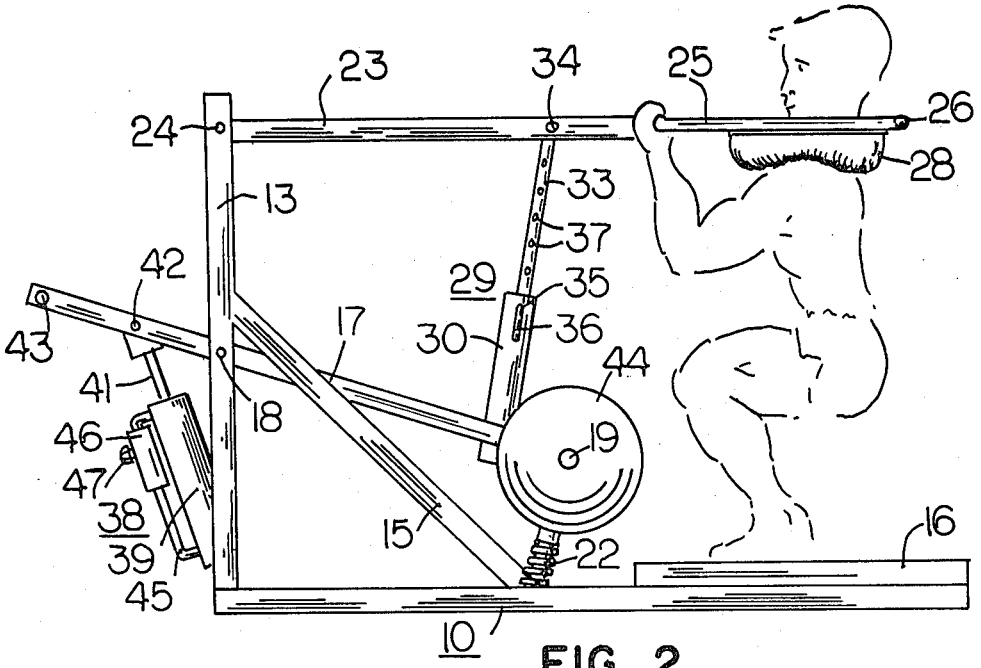
FIG. 2 is a side elevation view of the machine of FIG. 1 shown in one position of use.

The user of the exercise machine selects the weight to be placed on the rod 19 and places the weight discs in pairs on opposite ends of the rod, one such weight being indicated at 44 in FIG. 2. The user then adjusts the position of the beam 23 to hold the grip or shoulder pads at the height required for his exercise. This adjustment is effected by removing the pin 35 moving the rod 33 to its selected position and replacing the pin. In FIG. 2 a man is shown with the machine adjusted for a squat position and with the pads 28 against his shoulders while he is gripping the forward portion of the base unit 25. When the exerciser presses upwardly he raises the weights 44 from the rest 20 and the speed of his upward movement is limited to that determined by the setting of the isokinetic mechanism 38. In FIG. 2, the device 38 has been shown as including an outside passage or pipe 45 having an adjustable orifice or valve (not shown) in a casing 46 which may be adjusted by movement of a handle 47. Such adjustment determines the rate of movement which is permitted by the device 38. When the exercise is complete, the beams are again lowered until the rod 19 rests against the seats 20.

Figure 3:
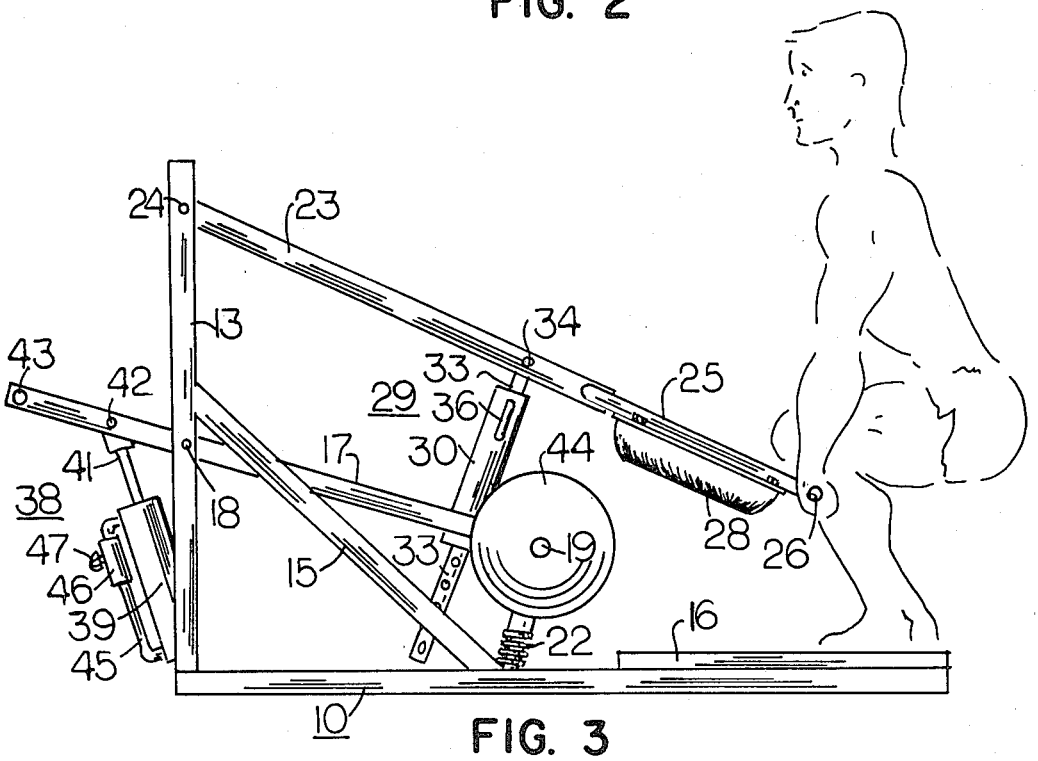
FIG. 3 is a side elevation similar to FIG. 2 showing a different position of use.

In FIG. 3 the machine is illustrated as adjusted for a straight arm lift of the weights wherein the user grips the handles 26 and 27 and rises from a squatting position. In this figure the rod 33 is illustrated as having passed through the bottom end of the sleeve 30 to its lowermost position. In the operation of the mechanism adjusted as indicated in FIG. 3 the user lifts the weights by direct pull on handles 26 and 27 and his rate of movement is controlled by the device 38.

Figure 4:
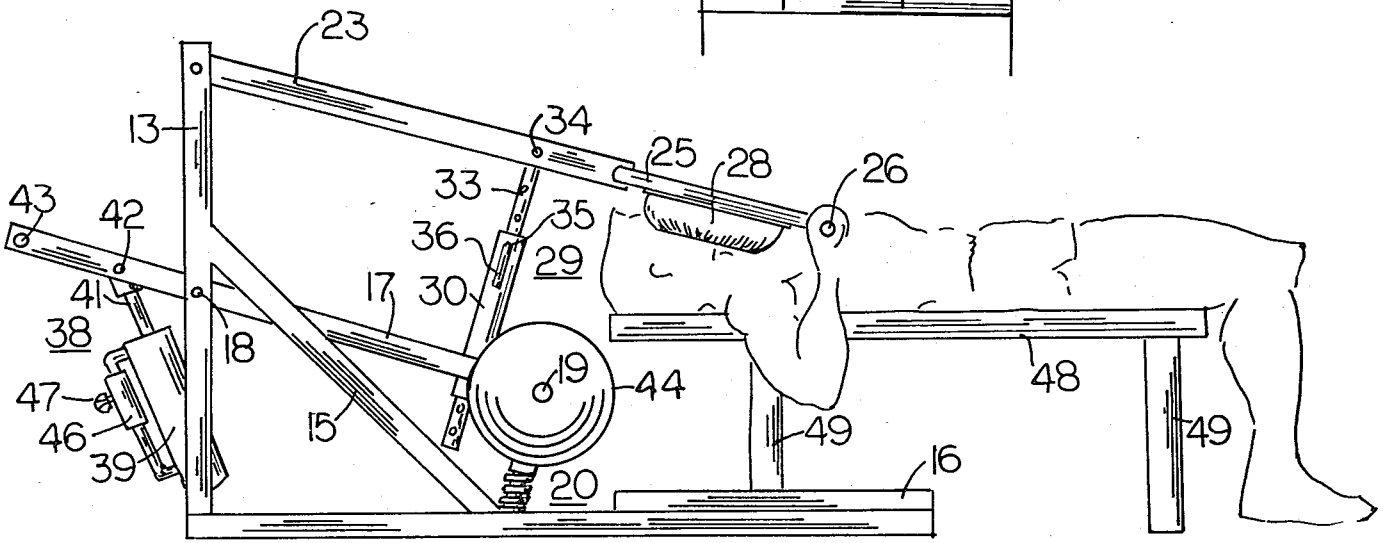
FIG. 4 is a side elevation view similar to those of FIGS. 2 and 3 showing a further use position.

In FIG. 4 the machine is shown adjusted to a position somewhat above that in FIG. 3 and the user is employing a bench 48 having legs 49 so that he may lie down with his head positioned between the shoulder pads 28 and his hands gripping the handles 26 and 27 in position for a chest press.

It will readily be apparent that the starting position for using the machine is easily selected by adjustment of the connecting link 29 and that no additional adjustment of the mechanism is required except for the selection of the weights to be used. For some exercises the equipment may be used without weights on the rod 19 and in such operation the movement of the user is opposed by the isokinetic unit 38 which operates to limit the rate of movement of the exerciser whether or not weights are present on the rod 19. For some exercises, particularly when the user is a beginner or does not have the ability to lift substantial weights positioned on the rod 19, it may be desirable to place weights on the rod 43 which then provide a force acting in the same direction as the user's efforts.

Figure 6:
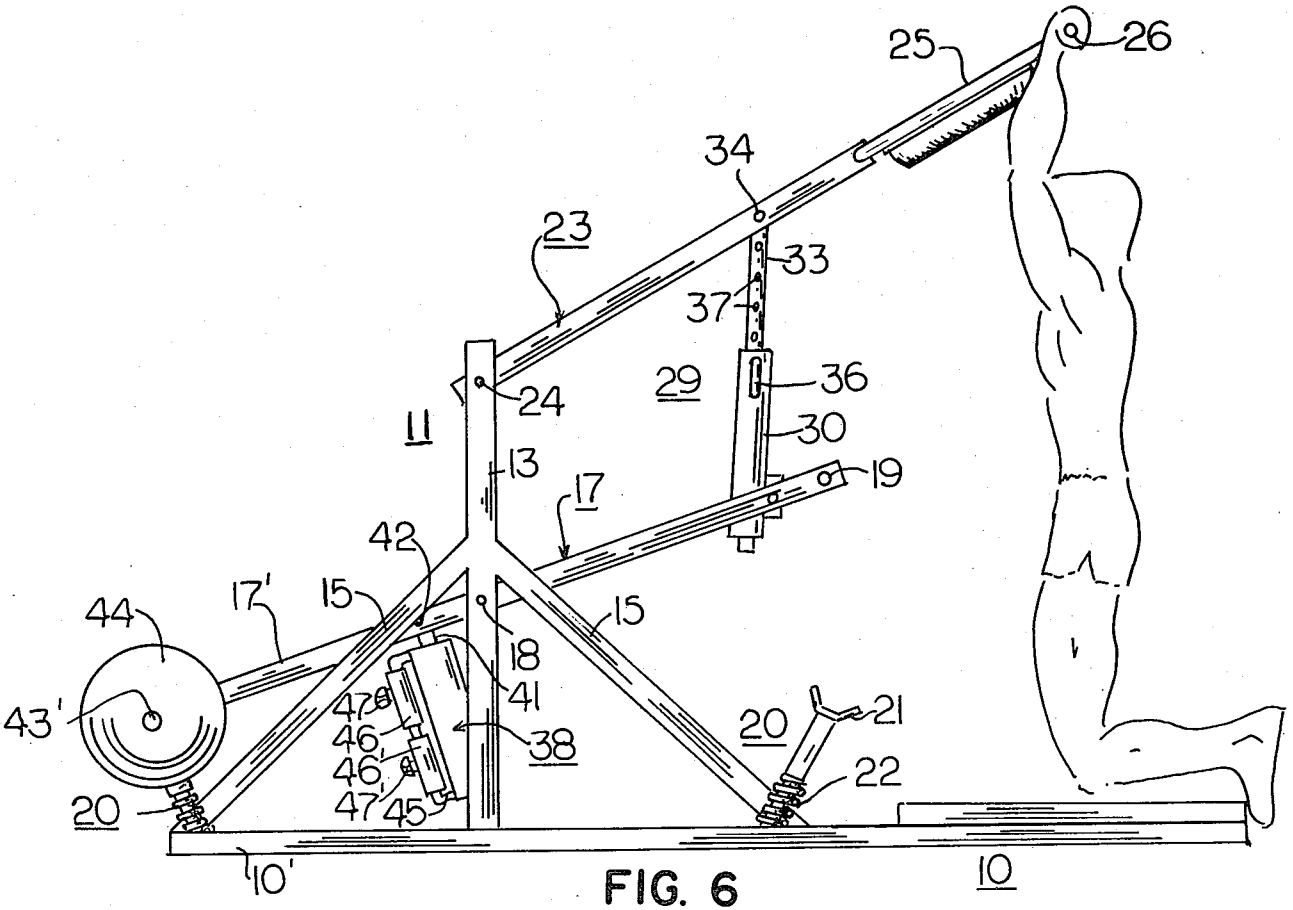
FIG. 6 is a somewhat diagrammatic isometric view of a machine illustrating another embodiment of my invention.

The exercising machine of FIG. 1 may also be employed for pull-down exercises. For this purpose the machine is preferably modified as shown in FIG. 6 by providing a substantial rearward extension of the beam 17 as indicated at 17' and mounting the weight carrying bar 43' at a distance from the beam pivot 18 substantially the same as that to the bar 19. The isokinetic unit is arranged to be actuated selectively in either direction and for the pull down exercise is arranged to control the speed of upward movement of the extension 17'. Two valves 46 and 46' are provided in the pipe 45 and are selectively placed in operation by adjustment of their control handles 47 and 47'. The valve 46 when activated controls downward movement of the rod 41 and the valve 46' controls upward movement. When in use as illustrated in FIG. 6 the valve 46' controls the rate of upward movement of the weight 44. When the handle 26 is pulled down the weight 44 is raised. A shock absorbing rest 20' is provided to receive the rod 43' and the weights 44 when they are lowered. This two-valve control for the isokinetic unit provides a simple arrangement for changing the direction in which the resistance of the unit is effective, and also provides an easily adjusted control. The same change in direction of the resistance provided by the isokinetic unit may be accomplished by disconnecting the rod 41 from its pivot to the beam 17 and moving it to a pivot on the forward side of the pivot 18.

Figure 7:
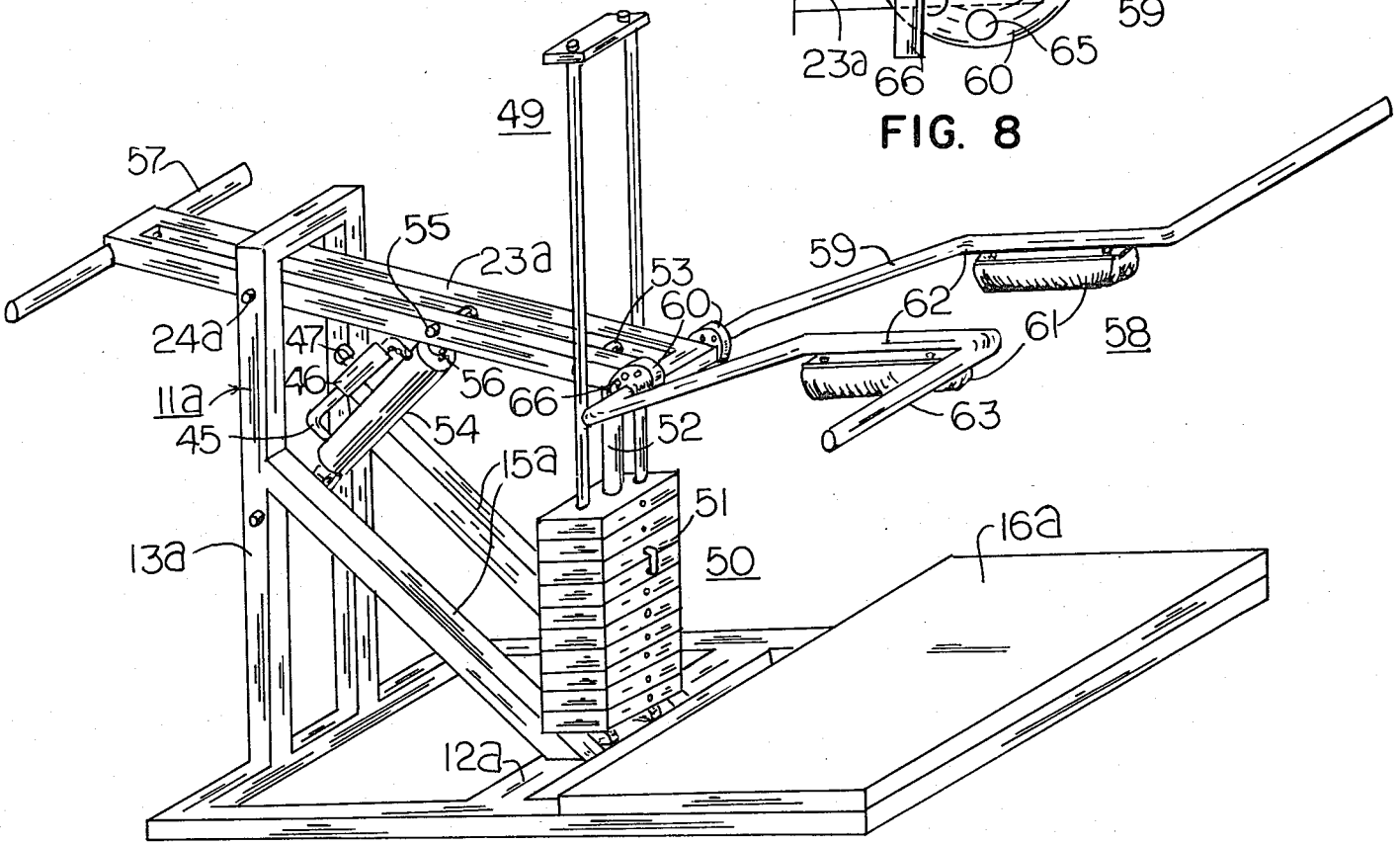
FIG. 7 is a somewhat diagrammatic side elevation view of a further embodiment of my invention.

The exercising machine illustrated in FIG. 7 is of somewhat similar construction to that of FIG. 1, and corresponding parts have been designated by the same numerals with the suffix letter "a". The machine in FIG. 7, instead of employing a second beam for carrying the weights, uses a vertical guide structure 49 on which a stack of plate weights 50 is slidably mounted. The guide structure 49 is pivoted at its bottom end to the cross-member 12*a* so that it may move about a horizontal axis parallel to the member 12*a* as the arm 23*a* moves in its arc about the pivot 24*a*. This weight arrangement is of a well-known type in which one or more weights may be secured to the lifting mechanism by operation of a key 51. Key 51 is arranged to be inserted through a hole in the selected weight and when pressed into the hole is moved into engagement with a vertical carrying member 52 which is pivotally secured to the beam 23*a* at 53. This machine employs the counter-balancing effect of weights which may be used in combination with the isokinetic mechanism to increase the range of exercise levels obtainable with the machine. The isokinetic mechanism indicated at 54 is pivotally connected to the upright structure 11*a* and to the beam 23*a* which has a shaft 55 to which the operating rod 56 of the device 54 is pivotally secured. The isokinetic device 54 is arranged to control the rate at which the rod 56 may be moved; the pivotal connection of the rod to the beam is on the opposite side of the beam pivot from that employed in FIG. 1, so that the device 54 is arranged to act in the opposite direction.

Figure 8:
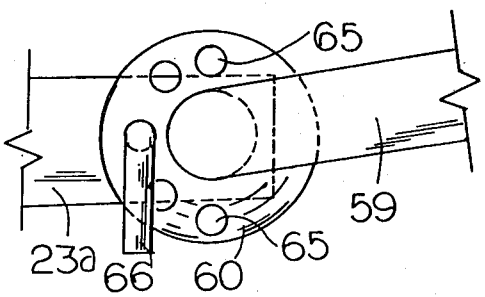
FIG. 8 is an enlarged view of an arm adjusting device used in the embodiment of FIG. 7.

The beam 23*a* which is pivoted on the shaft 24*a* extends beyond the upright structure 11*a* and has a weight receiving and holding rod 57 secured to its outer end. This rod is arranged to receive weight discs in the same manner as the rod 43 of the device FIG. 1, and is positioned to provide a weight stressing the beam 23*a* in the opposite direction to the weights 50. The forward end of beam 23*a* is provided with an adjustable handle assembly 58 which includes a U-shaped memer 59 which is pivotally mounted in the forward end of the beam 23*a* and is provided with adjusting plates or discs 60 which allow the U-shaped member to be positioned selectively at various angles with respect to the beam 23*a*. Shoulder pads 61 are provided on a downwardly bent portion 62 of the U-shaped member, laterally extending handles 63 and 64 are provided for gripping purposes. These handles correspond in function to the handles 26 and 27 of the embodiment of FIG. 1. The pivotally adjustable handle assembly 58 provides a wide range of positions of the pads and handles 63 and 64 with respect to the plane of the beam 23*a*. The adjusting arrangement is illustrated in FIG. 8 which shows the disc 60 as provided with a plurality of holes 65 spaced about a circle concentric with the axis of the member 59. The holes are positioned to register with a hole on the center line of the beam 23*a* and an L-shaped pin 66 is provided to pass through the registering holes and lock the arms 59 in their selected position.

The exercising apparatus as described herein is easily adjustable for the size of each user and for the selected exercises. While I have illustrated specific embodiments of my invention, other arrangements and applications will be apparent to those skilled in the art. I do not, therefore, desire my invention to be limited to the specific arrangements illustrated and described, and I intend by the appended claims to cover all modifications within the spirit and scope of my invention.

I claim:

1. An exercise equipment comprising an upright support, a first beam pivoted on said support about a horizontal axis, a second beam pivoted on said support on a horizontal axis below and parallel to the axis of said first beam and extending forwardly below said first beam, an adjustable connecting means pivoted at one end to said first beam remote from said support and pivoted at its other end to said second beam remote from said support, means for mounting weights on said second beam near its forward end whereby lifting of said first beam lifts said second beam and the weight thereon, a weight lifting bar and spaced shoulder pads mounted on said first beam at the outer free forward end thereof, said adjustable means varying the positions of said first beam relation to the second beam within a range of positions of a user from a low squat and lift position to a standing shoulder position, and an isokinetic means connected between said support and one of said beams for limiting the speed of movement of said beams to a predetermined rate.

2. An exercise equipment as set forth in claim 1 wherein said isokinetic means is connected between said support and said second beam, the connection with said second beam being located rearwardly of the pivotal support of said second beam.

3. An exercise equipment as set forth in claim 1 wherein the mounting for said bar and said pads comprises a generally U-shaped member secured to said first beam and having its arms extending forwardly therefrom and said shoulder pads are secured to respective ones of said arms.

4. An exercise equipment as set forth in claim 3 wherein said lifting bar is secured to and extends laterally outwardly from the end of one of said arms.

5. An exercise equipment as set forth in claim 1 wherein said adjustable member comprises a sleeve having its lower end pivotally secured to said second beam and an inner rod pivotally attached to said first beam and telescoping with said sleeve, said inner rod in its lowermost position extending through said sleeve with its bottom end positioned substantially below the lower side of said second beam.

6. An exercise equipment as set forth in claim 1 including a laterally extending bar on the end of said second beam rearwardly of the pivotal support thereof and adapted to carry weights for urging said second beam in the direction opposing said isokinetic means.

7. An exercise equipment as set forth in claim 1 wherein said second beam has a rearwardly extending portion of substantially the same length as its forwardly extending portion, means for mounting weights near the end of said rearward portion of said second beam, and means for adjusting said isokinetic unit to resist upward movement of said rearward portion.

8. An exercising equipment comprising a rigid upright support, a beam pivoted on said support about a horizontal axis, user engaging means connected to and extending forwardly from the front end of said beam, said engaging means including a pair of spaced bars each having a user engaging portion, means for connecting first weights to the forward end of said beam for lifting upon upward movement of said forward end, an isokinetic unit connected to limit the rate of upward movement of said forward end, and means for connecting a second weight to said beam for urging said beam in a direction opposing the weight of said forward end and acting in a direction opposing the resistance of said isokinetic unit.

9. An exercising equipment as set forth in claim 8 wherein said isokinetic unit is pivotally connected to said beam and to said support, and wherein said means for connecting said second weight is a weight support rigidly secured to said beam on the rearward side of its pivotal support.

10. An exercising equipment as set forth in claim 9 wherein said engaging means is pivotally mounted about a horizontal axis at the forward end of said beam and including means for adjusting the position of said engaging means about said axis.

11. An exercise equipment as set forth in claim 1 wherein said adjustable means comprises two telescoping sections one pivotally attached to said first beam and the other pivotally attached to said second beam, and means for locking said sections together in any one of a plurality of positions for determining the spacing between the forward ends of said beams.

* * * * *